United States Patent [19]

Vila Masot

[11] Patent Number: 4,706,073

[45] Date of Patent: Nov. 10, 1987

[54] CIRCUIT BREAKER PANELS WITH ALARM SYSTEM

[76] Inventor: Oscar Vila Masot, Doral Beach, Complejo Tucistico, "El Morro", Puerto de la Cruz, Venezuela

[21] Appl. No.: 760,925

[22] Filed: Jul. 31, 1985

Related U.S. Application Data

[63] Continuation-in-part of Ser. No. 654,157, Sep. 25, 1984.

[51] Int. Cl.[4] ..... G08B 21/00

[52] U.S. Cl. ..... 340/639; 337/206; 361/349

[58] Field of Search ..... 340/638, 639, 644; 361/114, 115, 344, 347, 349, 350, 357; 337/241, 242, 206, 265, 266, 332, 376

[56] References Cited

U.S. PATENT DOCUMENTS

| | | | |
|---|---|---|---|
| 2,460,758 | 2/1949 | Lawson | 340/638 X |
| 3,169,239 | 2/1965 | Lacey | 340/638 |
| 3,529,292 | 9/1970 | Neill et al. | 340/825.16 |
| 3,562,733 | 2/1971 | Murphy et al. | 340/638 |
| 3,662,369 | 5/1972 | Vinsani et al. | 340/638 |
| 3,670,301 | 6/1972 | Douglas | 340/65 |
| 3,683,350 | 8/1972 | Shedenheim | 340/638 |
| 3,696,364 | 10/1972 | Lavelle | 340/644 |
| 3,816,827 | 6/1974 | Lynn, Jr. | 340/638 X |
| 4,056,816 | 11/1977 | Guim | 340/638 |
| 4,358,810 | 11/1982 | Wafer et al. | 361/93 |
| 4,518,957 | 5/1985 | Wheeler | 340/639 |
| 4,611,201 | 9/1986 | Guim et al. | 340/638 |

FOREIGN PATENT DOCUMENTS

| | | |
|---|---|---|
| 3028518 | 2/1981 | Fed. Rep. of Germany . |
| 103897 | 3/1964 | Norway . |

*Primary Examiner*—James L. Rowland
*Assistant Examiner*—Jeffery A. Hofsass
*Attorney, Agent, or Firm*—Jack Q. Lever, Jr.; Mitchell B. Wasson; Martin P. Hoffman

[57] ABSTRACT

An alarm system used in conjunction with a circuit breaker panel box indicating the presence of an overload condition. At least one sensor is provided in proximity with the circuit breaker box but is not physically connected thereto. This sensor senses various parameters which are inherent in an overload condition or which are produced by various circuitry connected to the circuit breaker which are enabled during an overload condition. This alarm system is set by closing the door of the circuit breaker panel box.

27 Claims, 11 Drawing Figures

FIG. 1.
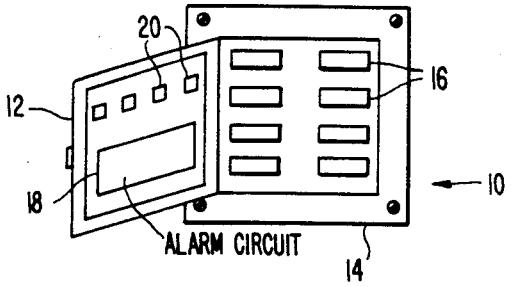
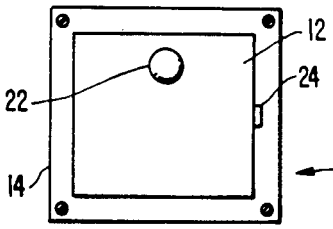
FIG. 2.
FIG. 3.
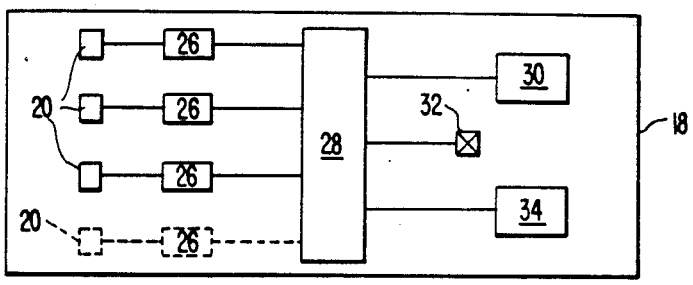
FIG. 4.
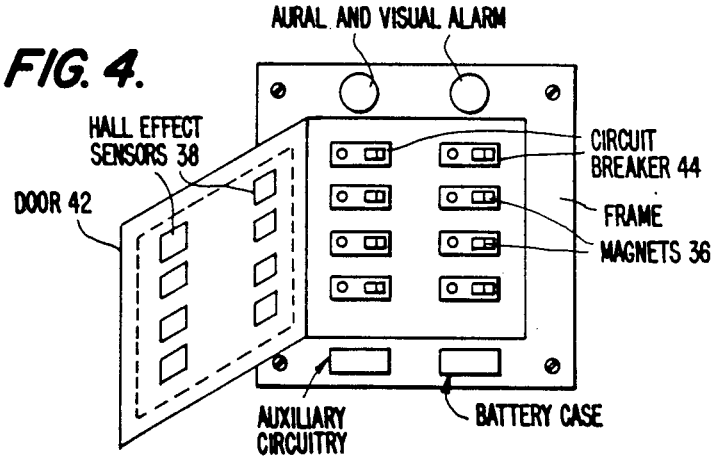

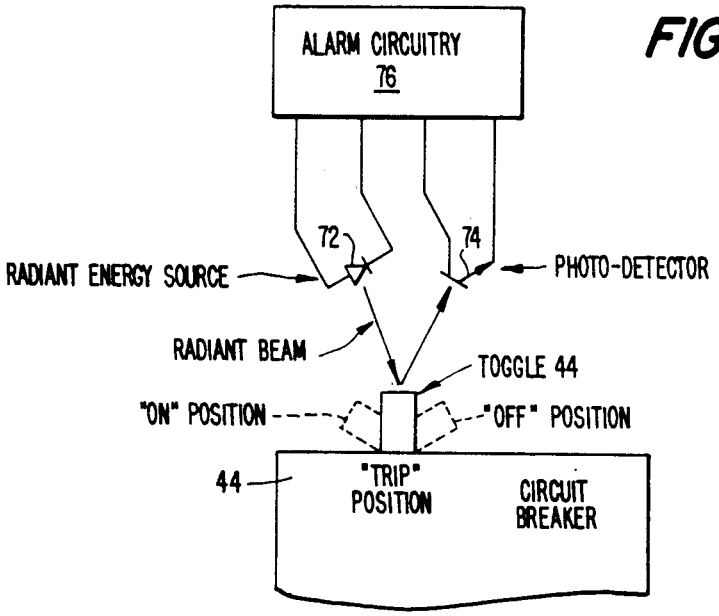
FIG. 10.
FIG. 11.
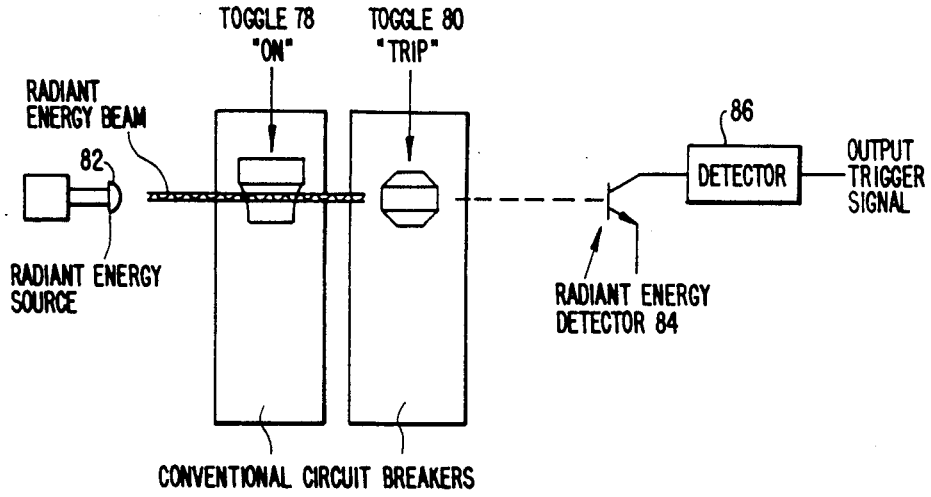

CIRCUIT BREAKER PANELS WITH ALARM SYSTEM

BACKGROUND OF THE INVENTION

This is a continuation-in-part application of Ser. No. 654,157 filed on Sept. 25, 1984.

Conventional circuit breakers are usually placed in operative position either singly or in banks of side-by-side units. These units can contain a handle which protrudes from the circuit breaker or a plurality of switches which are provided within the casing. When a number of such circuit breakers are in a group, as they conventionally are, it is often difficult to ascertain which circuit breaker has its handle or switch in a blown position, particularly since most circuit breakers are in cellars or in similar dimly-lit locations. In addition, even when the circuit breakers are in brightly-lit areas, it is often difficult to determine the particular circuit breaker which has blown. This, or course, is important since when an overload occurs and a circuit is blown, it must be found and corrected before resetting the circuit breaker, thereby considerably reducing the risk of life and material losses.

The prior art is replete with various devices containing a circuit breaker associated with a visual or aural indicator which positively shows which one of several circuit breakers has blown. One such device is described in U.S. Pat. No. 4,056,816 issued to Raul Guim, showing an illuminated circuit breaker utilizing a light-emitting diode to indicate when the circuit breaker has blown. This diode is provided in a circuit parallel to the main switch of the circuit breaker and when this switch is tripped due to the sensing of an overload condition, the light-emitting diode is connected into the circuit and begins to illuminate and remain lit until the problem is rectified. However, this patent does not disclose any means for sensing the presence of an overload condition other than by providing an indicating means directly connected into the circuit breaker circuit. Furthermore, the patent to Guim does not indicate the presence of any means for setting the alarm other than by directly connecting the circuit.

U.S. Pat. Nos. 2,460,758 issued to Lawson; 3,562,733 issued to Murphy et al; 3,683,350 issued to Shedenheim; 3,816,827 issued to Lynn, Jr. and 4,358,810 issued to Wafer et al all disclose circuit breakers having an alarm or other indication that a circuit has blown. For example, the patent to Lawson shows a lockout and alarm device for circuit breakers whereby the movement of a magnet causes a tripping arm to rotate and thereby allow a movable contact to engage a stationary contact, thereby completing an alarm circuit whereby a lamp lights or a bell rings. Similarly, the patents to Murphy et al, Shedenheim, Lynn, Jr. and Wafer et al are provided with alarm circuits which are provided in a circuit which is physically connected to either a device for sensing that an overload has occurred or the device which is tripped when the overload is sensed. Additionally, although the patents to Lawson and Murphy et al also describe a device for manually setting the alarm circuit, neither of these patents discusses such a setting device which is provided between the circuit breaker door and the door frame.

SUMMARY OF THE INVENTION

The present invention overcomes all of the difficulties of the prior art by providing an alarm system for a circuit breaker which senses the change of light, sound, vibration, temperature or ionization level which is produced by a thermoelectric or magnetic circuit breaker sensing an overload condition and tripping the circuit breaker switch, or senses the movement of the toggle switch associated with each circuit. More specifically, a plurality of sensors, each sensor associated with a single circuit breaker, sensitive to the parameters listed hereinbove are placed inside the circuit breaker panel box such that when any of a plurality of threshold levels are exceeded, as a result of the triggering of one or more of the circuit breakers inside the panel box, an audio, visual or additional signal or a combination thereof is produced. The sensors provided within the circuit breaker panel box are connected to an alarm means which is provided either directly in proximity with the circuit breaker panel box or at a distance from the electrical panel box in such a manner that an individual can perceive that one or more of the circuit breakers has been tripped and at the same time ensuring that the alarm signals cannot be damaged due to any problem within the electrical panel box. Additionally, a display can be utilized which specifically indicates the exact circuit breaker which has been tripped.

The above and other objects, features and advantages of the present invention will become more apparent from the following description thereof taken in conjunction with the accompanying drawings.

BRIEF DESCRIPTION OF THE DRAWINGS

FIG. 1 is a front view of a standard electrical panel box having its door open;

FIG. 2 is a front view of a conventional electrical panel box having its door closed;

FIG. 3 is a block diagram showing the wiring of the sensors;

FIG. 4 is a front view of an electrical panel box having its door open showing a second embodiment of the present invention;

FIGS. 7, 8, 9, 10 and 11 are block diagrams showing additional embodiments of the present invention.

DETAILED DESCRIPTION OF THE INVENTION

Figure 5:
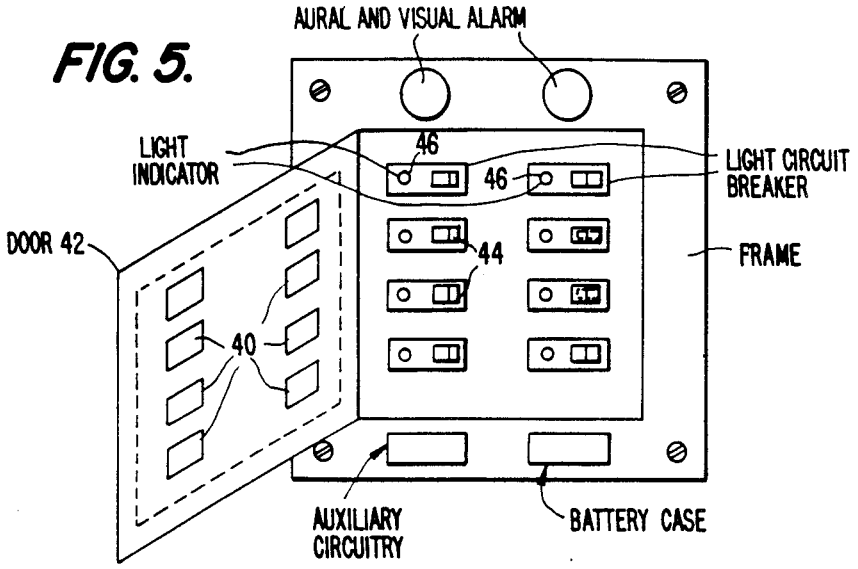
FIG. 5 is a front view of an electrical panel box having its door open showing a third embodiment of the present invention.

FIGS. 1 and 2 show a conventional electric circuit breaker panel box 10 provided with a door 12 and a frame 14. Within the panel box is provided a series of circuit breaker switches 16. These circuit breakers are conventional in nature and could consist of either a thermoelectrically sensitive bimetallic sensing member or a magnetic armature and coil. In either case, when an overload condition is sensed, a tripping arm connected to either the bimetallic element or the magnetic armature moves to open a switch thereby disconnecting a load from the line current. A plurality of sensors 20 is provided on the door 12. These sensors could be utilized to sense the presence of a light directly connected to the circuit breaker circuit which is activated when an overload condition occurs. Additionally, the sensor could be sensitive to the noise and/or vibration impact produced by the triggering of one or more conventional circuit breakers when an overload or a short circuit occurs, or can be sensitive to the temperature level or ionization level which is present during an overload condition. Electrical circuitry 18 is directly provided on the door 12 and includes a battery therewith for powering the circuit. This circuit is conventional in nature but will be discussed in more detail with respect to FIG. 3.

FIG. 2 shows the panel door 12 closed and includes a set-reset switch which is set once the door is closed and can only be reset by opening the front door 12. This allows an individual to visually inspect which circuit breaker has been tripped, thereby alerting the individual to an electrical malfunction in that circuit, thus preventing or considerably reducing the risk of fire. The sensors 20 are connected through the electrical circuit 18 to an alarm 22 which can be either visual, aural or another kind of alarm. Stationary contacts are provided on the door frame 14 and movable contacts are provided on the door latch 24. When these contacts abut one another, the alarm system is engaged.

FIG. 3 represents a block diagram showing a possible circuit which can be utilized with the alarm device. This circuit contains a plurality of sensors 20 which are each connected to individual signal conditioners 26. It should be noted that although three sensors are shown in FIG. 3, the present invention can utilize any number of sensors. This provision is shown in FIG. 3 by depicting three sensors and signal conditioners in solid and a single sensor and signal conditioner in phantom. All of the signal conditioners are connected to a signal mixer 28 which is connected to an alarm device 30 which would alert an individual that one or more of the circuit breakers has been activated. A set-reset switch 32 is provided which is armed by closing the door 12. As shown in FIG. 2, the switch 32 is engaged when the door 12 is closed. A battery 34 is included for energizing this alarm system.

Figure 6:
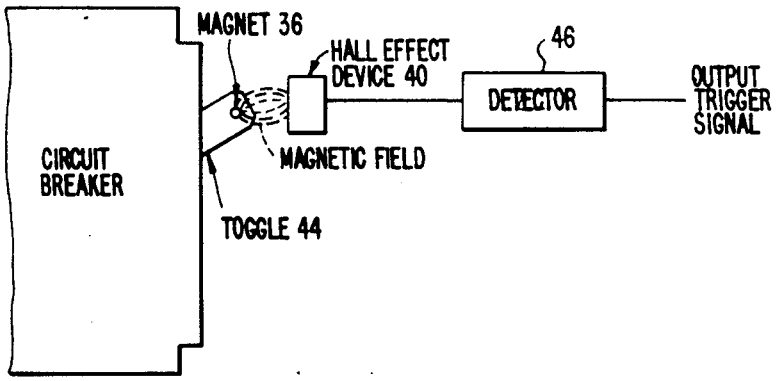
FIG. 6 is a block diagram of the electrical panel box shown in FIG. 4.

A second embodiment of the present invention is shown in FIG. 4 and FIG. 6 whereby the alarm circuitry and battery are provided on the door frame and not on the door. In this embodiment, permanent magnetic sensors could be located on the inside door 42 of the circuit breaker panel box for the purpose of detecting the movement of magnets 36 located on the toggles of the circuit breakers 44, such movement being produced by the triggering of one or more of the conventional circuit breakers when an overload or short circuit occurs. The magnet could be located directly on the toggle or embedded within it. A sensor, sensitive to the movement of the magnet 36, such as a Hall effect device 38 or other similar device, is mounted on the sheet metal door 42. Furthermore, any other type of indicator which is located on the toggles of the circuit breakers can cause appropriate sensors inside the circuit breaker panel box, such as photoelectric cells, Forward mass detectors, etc., to react thereby triggering an alarm or other signal. Accordingly, all such configurations should be considered to be embodiments of the present invention. The Hall effect device 40 senses a particular magnetic flux when it is in proximity to a magnetic field produced by the permanent magnet 36. A detector circuit 46 is used to sense this magnetic flux. Movement of the magnet 36, caused by the tripping of the circuit breaker associated with that magnet, causes a change of magnetic flux which is sensed by the Hall effect device and sensed by the detector circuit 46 which produces an output signal for triggering the aural and visual alarms.

A third embodiment of the present invention is shown in FIG. 5 whereby, similar to the embodiment shown in FIG. 4, the alarm circuitry and battery are provided on the door frame and not on the door. In this embodiment, a light sensor or a plurality of light sensors 40 is mounted on the inside of the circuit panel door 42. The circuit panel includes a plurality of circuit breaker switches 44 and a light-emitting diode, electroluminescent device 46 or similarly illuminated lamp associated with each switch. This particular type of alarm circuit breaker is described in U.S. Pat. No. 4,056,816. The circuit breaker described therein includes a light-emitting diode which would be tripped by an overload or a short circuit. Furthermore, the aural and visual alarms are also provided on the door frame. In operation, when one or more of the circuit breakers 44 is tripped by sensing an overload condition, the respective light-emitting diode 46 associated with each switch would be illuminated. The light produced by these diodes is sensed by the light sensors 40 provided on the door 42 of the circuit breaker panel box. These sensors are connected to a visual or aural alarm which would be perceived by an individual. Connections from the light sensors provided on the inside of the door to the associated circuitry, alarm and battery will be made across the hinge edge of the door and protected from potential physical abuse. Similarly, sound or vibration sensors could be located inside the circuit breaker panel box for the purpose of detecting the noise and/or vibration impact produced by the triggering of one or more conventional circuit breakers when an overload or short circuit occurs. These sensors are connected to a circuit which is designed to discriminate against noise-vibration impulses extraneous to the triggering of the circuit breakers.

Figure 7:
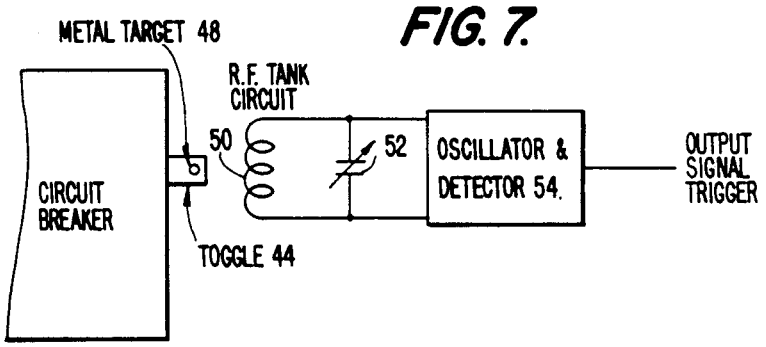

Yet another embodiment is shown in FIG. 7 which illustrates a sensor mechanism provided with a ferrous or non-ferrous metallic target material 48 applied to or embedded within the toggle 44 of the circuit breaker. A radio frequency (RF) tank circuit consisting of a coil of wire 50 and a capacitor 52 provides a tuned resonant circuit. This tank circuit utilizes an oscillator and detector circuit 54 to determine the position of the toggle switch 44. Each toggle 44 is provided with its own tank circuit which oscillates at a given frequency when the toggle 44 is in the ON or OFF position. This tank circuit could be located on the door of the circuit breaker panel box and the oscillator and detector circuit could also be provided directly on the door of the circuit breaker panel box as shown in FIG. 1, or on the main frame of the circuit breaker unit as shown in FIG. 4. However, when the toggle switch is in the tripped position as shown in FIG. 7, the metallic target material 48 is brought close to the RF field generated by the tank circuit which changes the impedance of the circuit due to the loading effect of the target material 48. This change in impedance is detected and an output signal results which is used to enable the aural and visual alarm signals.

Figure 8:
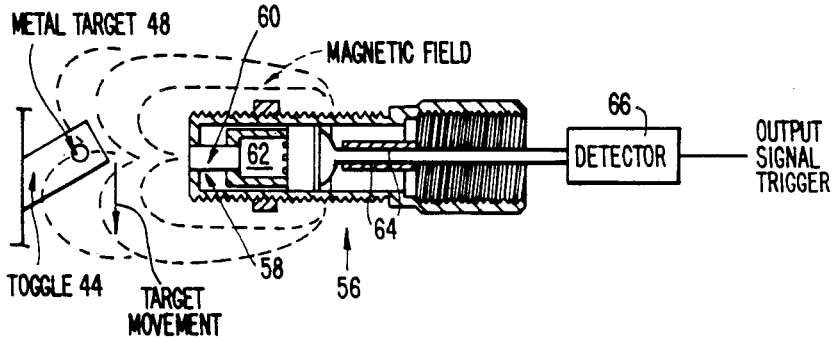

The embodiment shown in FIG. 8 describes an alarm sensing system utilizing the ferrous or non-ferrous metal target 48 described with respect to FIG. 7 as well as a variable reluctance magnetic sensor 56 having a coil of wire 58 and a ferrous pole piece 60 embedded in the coil. A permanent magnet 62 is actually affixed to the pole piece 60. The toggle 44 in FIG. 8 is shown in a non-tripped position. However, when the toggle is tripped and it moves to a tripped position to interrupt the magnetic flux or field generated by the magnetic sensor 56, the flux is changed and current is caused to flow in the coil, generating an output voltage pulse. This output voltage pulse is transmitted by signal wires 64 to a detector 66 which in turn produces an output signal which triggers the aural and visual alarms. The variable reluctance magnetic sensor 56 is associated with each of the circuit breaker toggles 44 and is located on the door of the circuit breaker panel box, and the detector 66 could also be provided directly on the door of the circuit breaker panel box as shown in FIG. 1, or on the main frame of the circuit breaker unit as shown in FIG. 4.

Figure 9:
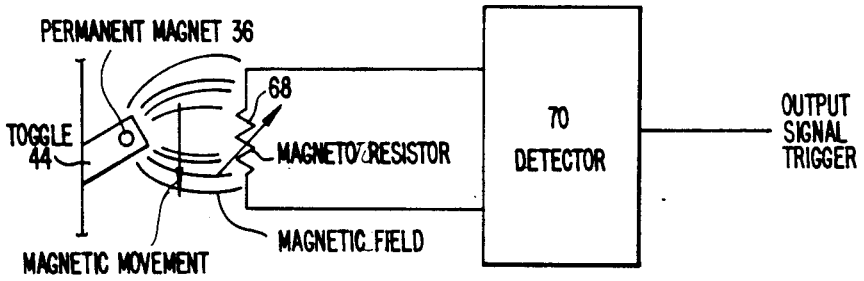

The embodiment illustrated with respect to FIG. 9 shows the use of a magneto-resistor 68 which changes resistance in the presence of a magnetic field. A permanent magnet 36 is embedded in or mounted upon the circuit breaker toggle 44. Movement of the toggle 44 from the non-tripped position shown in FIG. 9 to a tripped position, enables the permanent magnet 36 to come into proximity with the magneto-resistor, thereby changing the magnetic field. This change in the magnetic field alters the resistance of the sensor sensed by the detector 70 which in turn produces an output trigger signal used to activate the aural or visual alarms associated with the circuit breaker unit. The magneto-resistor 70 is associated with each of the circuit breaker toggles 44 and is located on the door of the circuit breaker unit and the detector 70 could also be provided directly on the door of the circuit breaker as shown in FIG. 1, or on the main frame of the circuit breaker unit as is shown in FIG. 4.

The embodiments shown in FIGS. 10 and 11 discuss alarm systems wherein the sensing or non-sensing of a radiant energy source, such as a light or infrared energy, is used to determine whether a circuit breaker toggle has been tripped. FIG. 10 shows a sensing device including a radiant energy source 72 provided on the door of the circuit breaker panel box. A radiant energy detector, such as photodetector 74, is also provided on the door of the circuit breaker panel box. One radiant source 72 and one radiant energy detector are associated with each of the circuit breaker toggles. As shown in FIG. 10, the radiant energy 72 and the detector 74 are positioned in such a manner that the radiant energy directed toward the toggle 44 is reflected off the toggle and received by the detector 74 only when the toggle is in the tripped position as illustrated in FIG. 10. When the toggle 44 is in the ON or OFF position as shown in phantom, the radiant energy produced by the radiant energy source 72 would not be reflected off of the toggle switch and received by the detector 74. Therefore, under normal conditions, radiant energy is not received by the radiant energy detector 74 and the alarm circuitry 76 does not enable the aural or visual alarms. However, when the circuit breaker senses an overload or short circuit condition, the toggle switch is tripped and the sensing of the radiant energy by detector 74 enables the alarm circuitry 76 to activate the aural and visual alarms. Alternatively, the radiant energy source-detector combination can be aligned such that the detector senses the radiation when the toggle is in the ON position, but when the toggle is tripped, no radiation is sensed and the alarm is activated. This alarm circuitry could be provided directly on the door of the circuit breaker as shown in FIG. 1, or on the main frame of the circuit breaker unit as shown in FIG. 4.

FIG. 11 is directed to an alarm sensing unit provided with a radiant energy source 82 producing radiant energy such as light or infrared energy. A radiant energy detector 84, such as a photodetector, is provided, as is the radiant energy source 82, directly on the circuit breaker frame, and is directly aligned with the radiant energy source 82. As shown, this particular embodiment can be provided with circuit breakers having a plurality of horizontally or vertically aligned toggle switches. FIG. 11 illustrates a situation in which the radiant energy detector 84 receives radiant energy produced by the radiant energy source 82 and directed parallel to the surface of the frame when all of the toggles are in either the ON or OFF position. However, when one of the toggle switches has been tripped, this toggle switch interrupts the beam of radiant energy. This interruption of energy is sensed by a detector circuit 86 and an output trigger signal is produced which enables the aural and visual alarms. This detector circuit 86 could be placed on the door of the circuit breaker as shown in FIG. 1, or on the circuit breaker frame itself as shown in FIG. 4. Additionally, the radiant energy source 82 and the radiant energy detector 84 can be aligned with respect to one another such that the beam of energy is normally interrupted when the toggle switches have not been tripped and the beam would be detected by the detector 84 when the toggle has been tripped. Of course, in this situation, only a single toggle switch can be utilized with a single radiant energy source-radiant energy detector pair.

During operation of any one of the embodiments of the present invention, the alarm circuitry and sensors are set by closing the electrical panel box. Thus armed, the visual or aural alarms would not be disabled until the electrical panel box is reopened.

Many changes and modifications in the above embodiments of the invention can, of course, be made without departing from the scope of the invention. For example, it is apparent that although the present invention has been primarily described with respect to an electrical circuit breaker panel box having the various alarm devices connected in proximity with the circuit breaker, it is envisioned that this need not be the case. If desired, a panel or control board may be mounted in an area which is quite a distance from the circuit breaker panel box. In this situation, a guard or similar security personnel provided at the entrance to various facilities such as an apartment building or office building would monitor the status of the circuit breaker panel box.

Furthermore, the embodiments described with respect to FIGS. 4–10 employ a separate detector for each of the toggle switches. Therefore, a display could be generated either in proximity to the circuit breaker unit or at a remote location for positively displaying the circuit breaker toggle which was tripped. This information could be connected to a standard memory device for permanently recording the time and occurrence of these events.

Additionally, the alarm system used in the present invention need not only be utilized in conjunction with conventional circuit breakers, but could be employed with any device which senses the occurrence of an overload or short circuit condition between a line current and a load, such as a fuse.

What is claimed is:

1. An alarm system used in conjunction with a conventional thermoelectrically or magnetically actuated device for sensing the occurrence of an overload condition or a short circuit condition between a line current and a load, said device provided in electrical panel devices, each panel box provided with a movable door and a fixed frame, the system comprising:

a movable switch provided in said thermoelectrically or magnetically actuated device, said movable switch movable from an ON position to a TRIPPED position when said device senses a circuit overload or short circuit condition;

alarm set-reset switch provided in said door and said frame of said electrical panel box, said door provided with a movable contact and said frame provided with a fixed contact engaged by said movable contact when said door is closed;

sensing means provided in proximity with device but physically and electrically disconnected from said device for sensing the actual physical movement of said switch responsive to the occurrence of an overload or short circuit condition as opposed to the result of said movement such as noise or vibration; and alarm means electrically connected to said sensing means for indicating the presence of an overload in a short circuit condition.

2. The alarm system in accordance with claim 1, wherein said alarm means is provided on the frame of said electrical panel box.

3. The alarm system in accordance with claim 1, wherein said alarm means is provided at a location remote from said electrical panel box.

4. The alarm system in accordance with claim 1, wherein said thermoelectrically or magnetically actuated device is a circuit breaker.

5. The alarm system in accordance with claim 1, wherein said thermoelectrically actuated device is a fuse.

6. The alarm system in accordance with claim 1, further including:

a permanent magnet connected to or embedded in said movable switch;

wherein said sensing means senses the movement of said movable switch to the TRIPPED position, thereby enabling said alarm means to indicate the presence of an overload or short circuit condition.

7. The alarm system in accordance with claim 1, further including:

a permanent magnet connected to or embedded in said movable switch;

wherein said sensing means senses the movement of said movable switch to the TRIPPED position, thereby enabling said alarm means to indicate the presence of an overload or short circuit condition.

8. The alarm system in accordance with claim 6, wherein said sensing means is a Hall effect sensor.

9. The alarm system in accordance with claim 7, wherein said sensing means is a Hall effect sensor.

10. The alarm system in accordance with claim 6, wherein said sensing means is a magneto-resistor.

11. The alarm system in accordance with claim 7, wherein said sensing means is a magneto-resistor.

12. The alarm system in accordance with claim 1, further including:

metallic material connected to or embedded in said movable switch;

wherein said sensing means senses the movement of said movable switch to the TRIPPRD position, thereby enabling said alarm means to indicate the presence of an overload or short circuit condition.

13. The alarm system in accordance with claim 1, further including:

metallic material connected to or embedded in said movable switch;

wherein said sensing means senses the movement of said movable switch to the TRIPPED position, thereby enabling said alarm means to indicate the presence of an overload or short circuit condition.

14. The alarm system in accordance with claim 12, wherein said sensing means is an RF tank circuit.

15. The alarm system in accordance with claim 13, wherein said sensing means is an RF tank circuit.

16. The alarm system in accordance with claim 12, wherein said sensing means is a variable reluctance sensor.

17. The alarm system in accordance with claim 13, wherein said sensing means is a variable reluctance sensor.

18. The alarm system in accordance with claim 1, wherein said sensing means is connected to said movable door.

19. The alarm system in accordance with claim 1, wherein said sensing means is connected to said fixed frame.

20. The alarm system in accordance with claim 1, wherein said sensing means includes:

a source of radiant energy provided in said panel box and direct toward said movable switch; and a radiant energy detector provided in said panel box aligned with said source of radiant energy and said movable switch to receive radiant energy when said movable switch moves to said TRIPPED position.

21. The alarm system in accordance with claim 1, further wherein said sensing means includes:

a source of radiant energy provided in said panel box and directed toward said movable switch; and a radiant energy detector provided in said panel box aligned with said source of radiant energy and said movable switch to receive radiant energy when said movable switch is in the ON position.

22. The alarm system in accordance with claim 1, wherein said sensing means includes:

a source of radiant energy provided in said panel box and directed toward said movable switch; and a radiant energy detector provided in said panel box aligned with said source of radiant energy and said movable switch to receive radiant energy when said movable switch moves to said TRIPPED position.

23. The alarm system in accordance with claim 1, wherein said sensing means includes:

a source of radiant energy provided in said panel box and directed toward said movable switch; and a radiant energy detector provided in said panel box aligned with said source of radiant energy and said movable switch to receive radiant energy when said movable switch is in the ON position.

24. The alarm system in accordance with claim 1, further including:

a plurality of aligned movable switches, each of said movable switches moved to a tripped position when a circuit overload or short circuit is sensed by the line associated with that particular switch;

a radiant energy source provided in said panel box and directed toward aligned movable switches; and a radiant energy detector provided in said panel box aligned with said source of radiant energy and said aligned movable switches to receive radiant energy when all of said aligned movable switches are in a non-tripped position.

25. The alarm system in accordance with claim 24, wherein said radiant energy detector does not receive radiant energy when one of said aligned movable switches moves to a tripped position, thereby activating said alarm means.

26. The alarm system in accordance with claim 1, further including:

a plurality of aligned movable switches, each of said movable switches moved to a tripped position when a circuit overload or short circuit is sensed by the line associated with that particular switch;

a radiant energy source provided in said panel box and directed toward said aligned movable switches; and a radiant energy detector provided in said panel box aligned with said source of radiant energy and said aligned movable switches to receive radiant energy when all of aligned movable switches are in a non-tripped position.

27. The alarm system in accordance with claim 26, wherein said radiant energy detector does not receive radiant energy when one of said aligned movable switches moves to a tripped position, thereby activating said alarm means.

* * * * *